United States Patent [19]

Gancia

[11] 4,285,226

[45] Aug. 25, 1981

[54] MANDREL-HOLDER FOR A PILGER ROLLING MILL

[75] Inventor: Emanuele Gancia, Milan, Italy

[73] Assignee: Innocenti Santeustacchio S.p.A., Brescia, Italy

[21] Appl. No.: 68,286

[22] Filed: Aug. 20, 1979

[51] Int. Cl.[3] ..... B21B 25/02

[52] U.S. Cl. ..... 72/208

[58] Field of Search ..... 72/208, 209, 214, 479

[56] References Cited

FOREIGN PATENT DOCUMENTS 988205 4/1965 United Kingdom ..... 72/208

558726 7/1977 U.S.S.R. ..... 72/209

*Primary Examiner*—Milton S. Mehr

[57] ABSTRACT

The mandrel-holder for a pilger rolling mill comprises a head with a seat for a tang end of a mandrel and a body coupled to an actuator for the mandrel-holder. A lever is pivoted on the body of said mandrel-holder and has a main portion extending in a recess formed in said body and opening on the said seat, means being provided in order to move the lever from an operative position in which its main portion is in said seat to an inoperative position in which its main portion is retracted into said recess against spring means.

3 Claims, 4 Drawing Figures

MANDREL-HOLDER FOR A PILGER ROLLING MILL

BACKGROUND OF THE INVENTION

The invention relates to a mandrel-holder for a pilger rolling mill, the holder being in one piece and comprising a head defining a seat adapted to receive and hold a tang end of a mandrel, and a body adapted for coupling to an actuator used for driving the mandrel-holder in rotation and in a straight line.

Usually the mandrel-holder head has a substantially U cross-section and the mandrel is secured to the mandrel-holder by inserting the mandrel tang between the sides of the head and removably securing it, e.g. by substantially male-female means. A bush is also used for coupling and is coaxially fitted on to the mandrel near its tang and adapted to engage a corresponding, substantially semiannular seat formed in the free end of the mandrel-holder head.

To ensure that the pilger rolling mill operates properly, it is necessary to prevent the mandrel coming loose from the mandrel-holder, as may happen, particularly in the case of older mandrel-holders, if the holder is in the upturned U position and the bush is not securely fitted in the corresponding seat of the mandrel-holder.

It has been frequently found that the aforementioned prior-art devices do not guarantee proper operation of the machine, more particularly when there is an increase in the speed of rolling and the angle of rotation during the positioning phase, e.g. in the case of more modern rolling mills, where use is also made of special devices which, even in the positioning stage, cause the mandrel and the bored blank to move along the entire stroke of the corresponding actuator.

The aforementioned problem has hitherto been solved by using devices which are mounted on the mandrel-holder and can move and secure an abutment means which is stationary in an operative position, in which it engages the mandrel tang (when the rolling mill is in operation) whereas when the abutment is in the inoperative position it is retracted into the mandrel-holder and disengaged from the tang (when the rolling-mill stops). The aforementioned devices usually comprise a double-acting pneumatic cylinder borne by the mandrel-holder with its axis parallel to the rolling axis and having a suitably dimensioned rod which constitutes the stationary abutment means for the mandrel tang.

It is very difficult, and not always possible, to ensure appropriate pneumatic communication between the ducts supplying the cylinder, which moves integrally with the mandrel holder, and the ducts from a compressed air source which is stationary and positioned outside the rolling mill. It is conventional to use stationary air chambers which partially surround the mandrel holder, but they are frequently inadequate and also constitute obstacles which undesirably reduce the accessibility of the mandrel-holder.

Furthermore, if the aforementioned devices are used, there is a need for suitable valve means for cutting off the compressed air, and for gaskets ensuring perfect sealing-tightness to compressed air under rather critical operating conditions. Another technical, more particularly economic, disadvantage is the possibility that the stationary abutment, i.e. the cylinder rod used for this purpose, will not be completely disengaged from the mandrel tang at the end of the rolling operation, so that when the mandrel is released from the mandrel-holder the abutment may be sheared away or sufficiently deformed to become unserviceable.

The invention is based on the problem of constructing a mandrel-holder for a pilger rolling mill having structural and functional characteristics which guarantee optimum engagement between the mandrel and the mandrel-holder during any phase of operation of the rolling mill, thus simultaneously overcoming the disadvantages mentioned hereinbefore with reference to the prior art.

SUMMARY OF THE INVENTION

To this end, the device according to the invention comprises:

A recess formed in the body and opening on to the seat,

A lever pivoted to the body, having its pivoting axis perpendicular to the longitudinal axis of the mandrel-holder, the level extending in an upper transverse position relative to the seat and comprising a substantially rod like portion extending outside the body and a main portion extending into the recess, the lever also being angularly movable around its pivot from an operative position in which its main portion extends into the seat into an inoperative position in which its main portion is retracted into the recess against the action of spring means, and A thrust means borne externally and independently of the mandrel-holder and adpated to act on the rod portion of the lever in order to move the lever through an angle into the inoperative position against the action of the spring means.

Advantageously, when the lever is in the operative position, its main portion is inserted like a wedge between the tang of the mandrel and the body of the mandrel-holder.

BRIEF DESCRIPTION OF THE DRAWINGS

Other features and advantages of the invention will be clear from the description of an embodiment of a mandrel-holder according to the invention given hereinafter with reference to the accompanying drawings, which are given by way of non-limitative embodiment only. In the drawings.

DESCRIPTION OF A PREFERRED EMBODIMENT

Figures 1, 3:
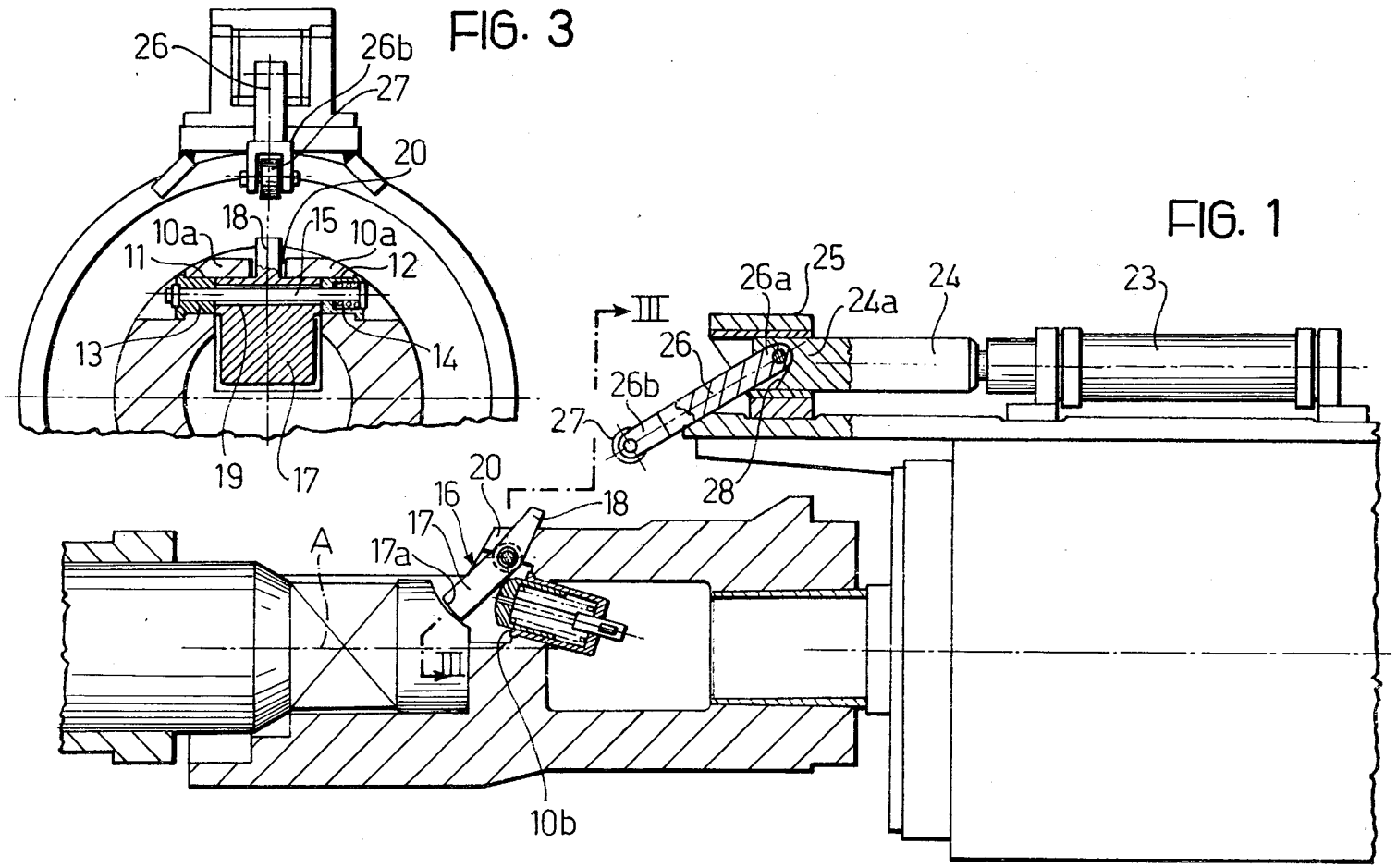
FIGS. 1 and 2 are views in longitudinal section of a mandrel-holder according to the invention in two different operating conditions.
FIG. 3 is a section along line III—III of FIG. 1.

In the drawings, the general reference 1 denotes a mandrel-holder for a pilger rolling mill, the holder being in one piece and mainly comprising a head 2 having a substantially U cross-section and an axially bored body 3 designed in conventional manner to be rigidly coupled to a piston 4 of an actuator, e.g. an "air-water chamber" 5 which is adapted to drive holder 1 in rotation and in a straight line as conventionally required during operation of a pilger rolling mill.

Head 2 is formed with a seat 6 bounded by a transverse wall 7 on its side facing body 3 and dimensioned by conventional manner so as to receive (and hold) a tang end 8 of a mandrel 9. Reference 9*a* denotes a conventional bush coaxially mounted on mandrel 9 and adapted to abut the end of a blank (not shown) for rolling.

Wall 7 is formed with a recess 10 having predetermined transverse dimensions and depth, the recess being open towards a seat 6 for receiving the mandrel tank, at a predetermined distance from the bottom of seat 6. Reference 10*a* denotes a wall having a constant predetermined thickness and bounding the top of recess 10, whereas 10*b* denotes the bottom wall of the recess.

Two similar through apertures 11, 12 are formed in the body 3 of mandrel-holder 1 in an upper position relative to recess 10 and on the two opposite sides thereof parallel to the sides of the mandrel-holder head 2. Apertures 11, 12 have a common axis extending perpendicularly to the axis A of the mandrel-holder body. A friction-type bearing 13, 14 is disposed by conventional means in apertures 11, 12 respectively. The bearings hold a pivot 15 on which a lever (general reference 16) is rotatably mounted.

More particularly, lever 16 comprises a main portion 17 and a substantially rod like portion 18 having a predetermined length and transverse dimensions considerably less than the transverse dimensions of the main portion 17. The main portion 17 has a transverse aperture 19 which coaxially and freely receives pivot 15 with a predetermined clearance. Portion 17 extends in recess 10 and its free end 17*a* is rounded so as to follow a curved wall 8*a* of the tang end 8 of mandrel 9. The rod portion 18 of lever 16 extends outside body 3 of holder 1 through a slot 20 longitudinally formed in the body in the position above recess 10.

Lever 16 is angularly movable around pivot 15 from an inoperative position in which its portion 17 is completely retracted into aperture 10 to an operative position in which its main portion 17 has its free end 17*a* in contact with the curved wall 8*a* of tang 8, as will be more clearly shown in the description hereinafter.

The general reference 21 denotes a spring piston 22 mounted in the bottom wall 10*b* of recess 10. Piston 21 urges the main portion 17 of lever 16 outside recess 10 and towards the aforementioned operaing position 16. Lever 16 is firmly held in the aforementioned operating position of spring piston 21–22 and by contact between the rod portion 18 and the bottom wall 20*a* of slot 20, which stops the angular motion of lever 16 around pivot 15.

Figure 2:
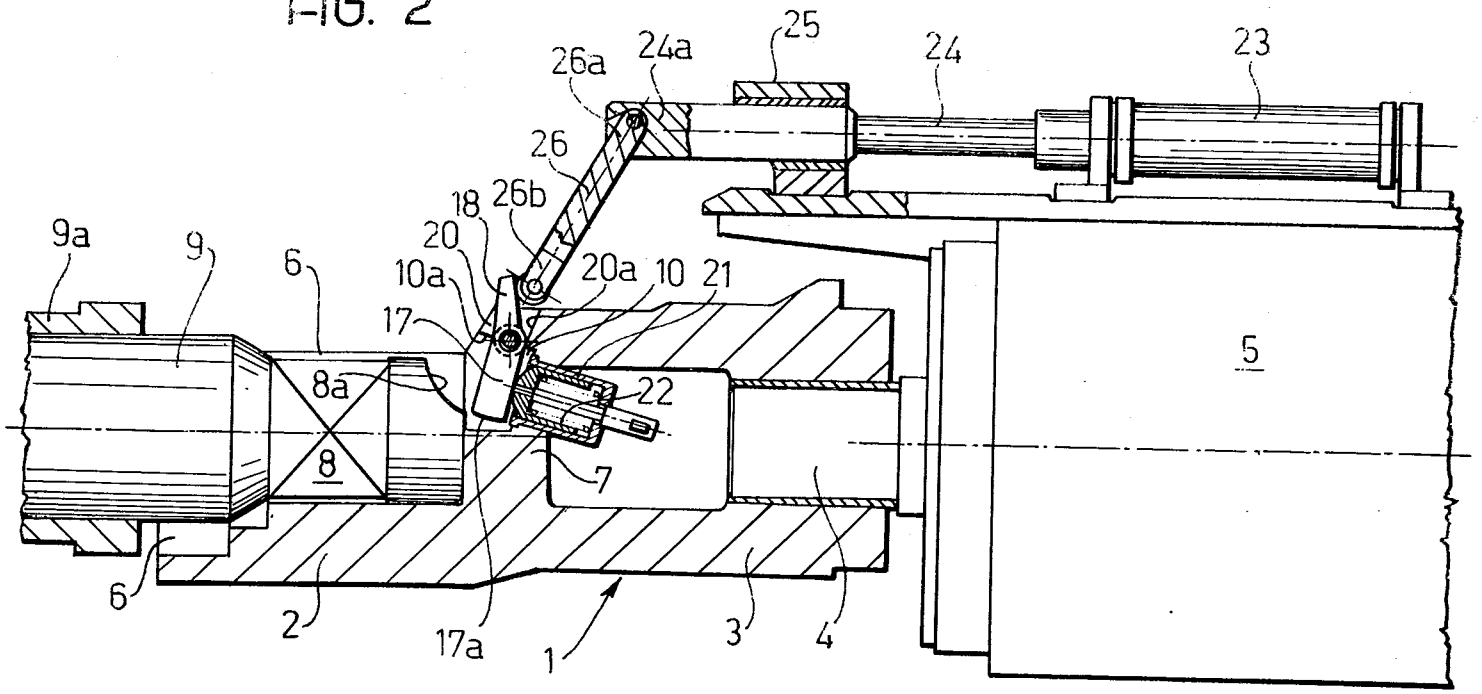
Figure 4:
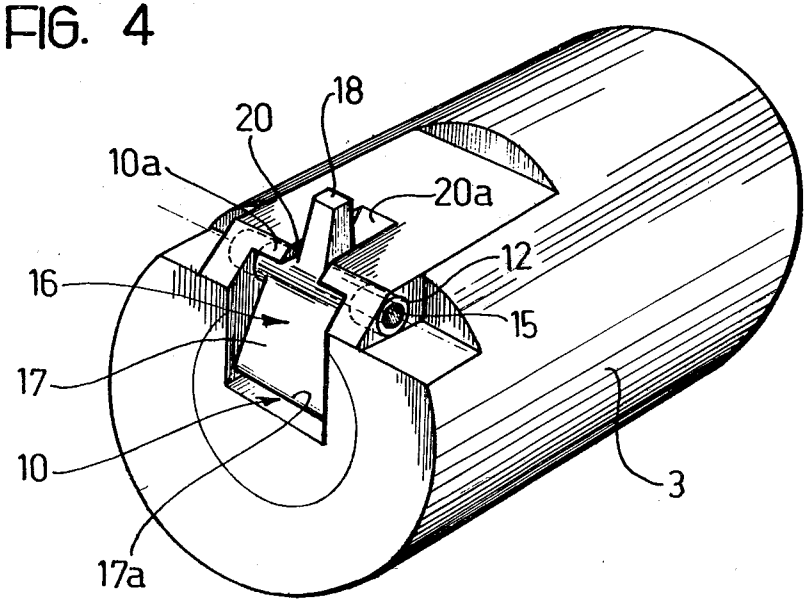
FIG. 4 is a partly cut-away perspective view of some separate features of the mandrel-holder in the preceding Figures.

Piston 21–22 also opposes the motion of lever 16 towards the inoperative position (FIG. 2).

A double-acting cylinder 23 is secured by conventional means to the fixed body of air-water chamber 5. The axis of cylinder 23 is horizontal and parallel to the axis of mandrel holder 1. The cylinder has a rod 24 guided by a conventional holder 25 and secured in a position above mandrel 1.

The top end 26*a* of an arm 26 having a predetermined length is secured to the free end 24*a* of rod 24. The other end 26*b* of the arm is forked and bears an idle roller 27. A suitably inclined wall 28 is formed in end 24*a* of rod 24 and stops the angular motion (anticlockwise in FIGS. 1 and 2) of arm 26 around its pivot.

Rod 24 is movable from a retracted position in cylinder 8 (FIG. 1), in which arm 26 is raised and at a distance from the mandrel-holder 1, to a position (FIG. 2) completely outside cylinder 23, in which the idle roller 27 of arm 26 presses lever 16 and holds it in the inoperative position (FIG. 2) against the action of the spring piston 21–22.

The mandrel-holder according to the invention operates as follows:

Initially, before tang 8 of mandrel 9 is inserted in the corresponding mandrel-holding head 2, lever 16 is held by the action of spring piston 21–22 and abutment 20*a* in the operative position illustrated in FIG. 1. When tang 8 is inserted in head 2, it presses lever 16 towards the inoperative position against the resilient action of piston 21. In other words, lever 16 does not hinder the insertion of tang 8 into the mandrel-holding head 2.

Next, after the insertion has taken place, i.e. when the curved wall 8*a* of tang 8 is pressed against recess 10, lever 16 is free, under the action of resilient piston 21, to return to its operating position in which its free end 17*a* is in contact with the curved wall 8*a*. In the last-mentioned state, the main portion 17 of lever 16 acts like a wedge inserted between the wall of tang 8 and the top wall 10*a* of recess 10.

When a blank is being rolled, mandrel 8 cannot come out of mandrel-holder 1, irrespective of the angular position thereof, since the main portion 17 of lever 16 acts as a positioning means and prevents the mandrel coming loose.

In order to avoid over-dimensioning the lever-holding means (pivot 15 and bearings 13, 14), the reaction to the impacts to which the mandrel 8 is subjected during rolling is discharged from the mandrel to the mandrel-holder 1 via the main portion 17 (the wedge and prong) of lever 16. This can be done by providing a uniform clearance between the through aperture 19 and pivot 15, around which the lever is angularly movable, held by the conical ends of bearings 13 and 14. In order to change the mandrel at the end of a rolling operation, cylinder 23 is actuated in the direction in which rod 24 extends. As a result, arm 26 bends downwards until it is stopped by contact with the abutment wall 28 formed in the free end 24*a* of rod 24. The inclination of wall 28 and the length of arm 26 are determined so that, under the aforementioned conditions, the idle roller 27 partly impedes the rod portion 18 of lever 16. Consequently, when rod 24 advances further, roller 27 makes contact with the lever portion 18 and moves it against the action of spring piston 21, 22 through an angle into an inoperative position, completely retracted in recess 10. When lever 16 is in the last-mentioned position (FIG. 2), the tang 8 of mandrel 9 is free and can be unthreaded, by conventional means, from the mandrel-holder head 2.

The main advantages of the mandrel-holder according to the invention are as follows:

The mandrel is firmly secured in the holder, both in the positioning phase and in the rolling phase, without using a conventional bush;

The mandrel can be loaded in conventional manner without any need for special, laborious checks of the position of the device for securing the mandrel in the mandrel-holder;

There is no risk that the mandrel-securing device will remain partly inserted when the mandrel is discharged from the mandrel-holder, and thus no possibility that the device will become seriously deformed;

Operation is reliable, the construction is simple and economic, and the same applies to the control and manipulation of the means (cylinder 23, rod 24, arm 27) actuating the securing device, in that the means are stationary and mounted on a fixed structure (the air-water chamber) outside the mandrel-holder, and The mandrel can be discharged only after the securing device has been completely disconnected, since the condition in question can easily be indicated in conventional manner by a limit stop of rod 24 of piston 23, mounted in a stationary position outside the mandrel-holder.

What we claim is:

1. In a mandrel-holder for a pilger rolling mill which is in one piece and comprises a head defining a seat adapted to receive and hold a tang end of a mandrel and a body adapted for coupling to an actuator used for driving the mandrel-holder in rotation and in a straight line, the improvement comprising:

a recess formed in the said body and opening on to the said seat, a lever pivoted to the said body, having its pivoting axis perpendicular to the longitudinal axis of the mandrel-holder, the lever extending in an upper transverse position relative to the said seat and comprising a substantially rodlike portion extending outside the said body and a main portion extending into the recess, the lever also being angularly movable around its pivot from an operative position in which its main portion extends into the said seat into an inoperative position in which its main portion is retracted into the recess against the action of spring means, and a thrust means borne externally and independently of the mandrel-holder and adapted to act on the rodlike portion of the said lever in order to move the lever through an angle into the inoperative position against the action of the spring means.

2. A mandrel-holder according to claim 1, in which when the said lever is in the operative position, its main portion is inserted like a wedge between the said tang of the mandrel and the said body of the mandrel-holder.

3. A mandrel-holder according to claim 1, in which the thrust means comprises an arm having an end adapted to act on the said rodlike portion of the lever, whereas the other end of the arm is mechanically controlled by an actuator.

* * * * *

UNITED STATES PATENT AND TRADEMARK OFFICE

CERTIFICATE OF CORRECTION

PATENT NO. : 4,285,226

DATED : August 25, 1981

INVENTOR(S) : Emanuele Gancia

It is certified that error appears in the above—identified patent and that said Letters Patent is hereby corrected as shown below:

ON THE TITLE PAGE INSERT:

--FOREIGN APPLICATION PRIORITY DATA

Sept. 4, 1978 Italy 27287A/78--

Signed and Sealed this

*Nineteenth* Day of *January 1982*

[SEAL]

*Attest:*

GERALD J. MOSSINGHOFF

*Attesting Officer*

*Commissioner of Patents and Trademarks*